US005866529A

United States Patent [19]

Erilli et al.

[11] Patent Number: 5,866,529

[45] Date of Patent: Feb. 2, 1999

[54] HIGH FOAMING NONIONIC SURFACTANT BASE LIQUID DETERGENT COMPRISING GELATIN BEADS

[75] Inventors: Rita Erilli, Liege; Chantal Gallant, Cheratte, both of Belgium

[73] Assignee: Colgate-Palmolive Co, Piscataway, N.J.

[21] Appl. No.: 717,993

[22] Filed: Sep. 20, 1996

[51] Int. Cl.[6] ..... C11D 1/83; C11D 3/02

[52] U.S. Cl. ..... 510/425; 510/424; 510/426; 510/423; 510/427

[58] Field of Search ..... 510/122, 424, 510/426, 427, 423, 425

[56] References Cited

U.S. PATENT DOCUMENTS

| | | | |
|---|---|---|---|
| 3,720,629 | 3/1973 | Sharman | 252/161 |
| 3,882,038 | 5/1975 | Clayton et al. | 252/89 |
| 4,294,718 | 10/1981 | Kaeser | 252/135 |
| 4,749,516 | 6/1988 | Brusky | 252/546 |
| 4,818,292 | 4/1989 | Iley et al. | 106/210 |
| 4,923,635 | 5/1990 | Simion et al. | 252/545 |
| 5,102,573 | 4/1992 | Han et al. | 252/153 |
| 5,171,475 | 12/1992 | Freisseleben | 252/312 |
| 5,252,245 | 10/1993 | Garabedian et al. | 252/152 |
| 5,302,377 | 4/1994 | Pereira et al. | 424/59 |
| 5,385,696 | 1/1995 | Repinec et al. | 252/550 |
| 5,387,375 | 2/1995 | Erilli et al. | 252/546 |
| 5,389,304 | 2/1995 | Repinec et al. | 252/546 |
| 5,389,305 | 2/1995 | Repinec et al. | 252/549 |

*Primary Examiner*—Paul Lieberman
*Assistant Examiner*—Nicholas Ozder
*Attorney, Agent, or Firm*—Richard V. Fisher

[57] ABSTRACT

A high foaming, nonionic surfactant based, light duty, liquid detergent with desirable cleansing properties and mildness to the human skin comprising a water soluble nonionic surfactant, a sulfate anionic surfactant, a sulfonate anionic surfactant, a water soluble, foaming zwitterionic betaine surfactant, an oil containing gelatin bead, a clay and water.

8 Claims, No Drawings

HIGH FOAMING NONIONIC SURFACTANT BASE LIQUID DETERGENT COMPRISING GELATIN BEADS

FIELD OF THE INVENTION

The present invention relates to novel light duty liquid detergent compositions with high foaming properties, containing a nonionic surfactant, two anionic surfactants, a zwitterionic betaine surfactant, gelatin beads containing an oil, Laponite clay and the balance being water.

BACKGROUND OF THE INVENTION

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

However, none of the above-cited patents discloses a high foaming, liquid detergent composition containing a nonionic surfactant, two high foaming anionic surfactants, a zwitterionic surfactant selected from betaine type surfactants, an oil containing gelatin bead, a Laponite clay and water wherein the composition does not contain any polymeric thickeners such as xanthan gum or polyacrylic acids.

SUMMARY OF THE INVENTION

It has now been found that a high foaming liquid detergent has desirable cleaning properties, mildness to the human skin.

Accordingly, one object of the invention is to provide novel, high foaming, light duty liquid detergent compositions containing a nonionic surfactant, oil containing gelatin beads and a Laponite clay.

Another object of this invention is to provide novel, liquid detergent compositions containing a nonionic surfactant, two anionic surfactants, a zwitterionic betaine surfactant, a clay, oil containing gelatin beads and water, wherein the composition does not contain any builder salts, polymeric thickeners, alkyl glycine surfactant, cyclic imidinium surfactant, N-polyvinyl pyrrolidone homopolymer, copolymer of N-polyvinyl pyrrolidone and dimethyl-aminoethyl methacrylate, or abrasives.

Still another object of this invention is to provide a novel, liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, nonionic based, light duty liquid detergent of this invention comprises four essential surfactants a water soluble, ethoxylated, nonionic surfactant, two anionic surfactants selected from the group consisting of water soluble organic sulfates and organic sulfonates, and a zwitterionic surfactant selected from the class of betaines, a clay, an oil containing gelatin bead, wherein the composition does not contain any amine oxide, formate, HETDA, abrasives, builder salts, polymeric thickeners, fatty acids, alkyl glycine surfactant or cyclic imidinium surfactant.

DETAILED DESCRIPTION OF THE INVENTION

The present invention relates to a light duty liquid cleaning composition which comprises approximately by weight:

(a) 9% to 30% of a nonionic surfactant;

(b) 0.5 to 8% of a zwitterionic surfactant;

(c) 0.25% to 6% of an anionic sulfonate surfactant;

(d) 2% to 15% of an anionic sulfate surfactant;

(e) 0 to 4% of an alkyl monoethanol amide;

(f) 0.1% to 2.5% of a Laponite clay;

(g) 0.05% to 2% of an oil containing gelatin beads; and (h) the balance being water.

The nonionic surfactant which constitutes is present in amounts of about 9% to 30%, preferably 13% to 25%, by weight of the composition. The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic surfactants generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8–15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri- $C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The anionic sulfonate surfactant, which is an essential ingredient of present liquid detergent composition, constitutes about 0.25% to 6%, preferably 0.5% to 5%, by weight thereof and provides good foaming properties.

The anionic sulfonate surfactants are water soluble such as triethanolamine and include the sodium, potassium, ammonium and ethanolammonium salts of linear $C_8$–$C_{16}$ alkyl benzene sulfonates and $C_{10}$–$C_{20}$ paraffin sulfonates. The preferred paraffin sulfonate is present in the composition as the sodium salt at a concentration of about 0.25 to about 6 wt. %, more preferably about 0.5 to about 5 wt. %.

The anionic sulfate surfactant is present in the composition at a concentration of about 2 to about 15 wt. %, and more preferably about 4 to about 13 wt. %. The anionic sulfate surfactants are water soluble such as triethanolamine and include the sodium, potassium and ammonium salts of $C_8$–$C_{18}$ alkyl sulfates such as lauryl sulfate and myristyl sulfate and the like.

The water-soluble zwitterionic surfactant, which is also an essential ingredient of present liquid detergent composition, constitutes about 0.5 to 8%, more preferably 1.0 to 6%, by weight and provides good foaming properties and mildness to the present nonionic based liquid detergent. The zwitterionic surfactant is a water soluble betaine having the general formula:

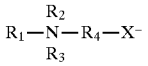

wherein $X^-$ is selected from the group consisting of $CO_2^-$ and $SO_3^-$ and $R_1$ is an alkyl group having 10 to about 20 carbon atoms, preferably 12 to 16 carbon atoms, or the amido radical:

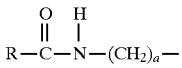

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 13 and Golmschmidt Betaine L7.

All of the aforesaid four ingredients in this light duty liquid detergent are water soluble or water dispersible and remain so during storage.

This particular combination of two anionic surfactants and betaine surfactant, provides a detergent system which coacts with the nonionic surfactant to produce a liquid detergent composition with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy as an anionic based light duty liquid detergent (LDLD).

The oil containing gelatin beads which function as a moisturizing agent in the composition are present in the composition at a concentration of about 0.05 to 2.0 wt. %, more preferably 0.1 to 1.0 wt. %. The gelatin beads have an average diameter of about 1000 to about 1400 microns. The bead is composed typically of gelatin and arabeo gum. The composition microencapsulated within the gelatin bead comprises approximately by weight 30 to 50% of a mineral oil, 30 to 50% of phytocancentrol algas, 10 to 30% of silicone oil and 1 to 3% of a silver pigment. A typical gelated bead is HC774 manufactured by Hallcrest of Dorset, England.

The Laponite clay is used in the instant composition at a concentration of about 0.1 to 2.5 wt. %, more preferably 0.2 to 2 wt. % is a synthetic clay which optionally has at least 5.0 wt. % of tetrapotassium pyrrophosphate peptizer such as Laponite RDS. The particle size of Laponite RDS which is manufactured by Laponite Inorganics of Great Britain has a particle size of <2% greater than 250 microns a bulk density of about 1000 $Kg/m^3$, and a surface area of about 330 $m^3/g$. Laponite RD does not have a peptizer has a particle size of <2% greater than 250 microns, a surface area of about 370 $m^2/g$ and a bulk density of about 1000 $Kg/m^3$.

The essential ingredients discussed above can be solubilized in one preferred embodiment of the invention in an aqueous medium comprising water and an alkyl monoethanol amides such as $C_{12}$–$C_{14}$ alkyl monoethanol amide (LMMEA) at a concentration of 0 to 4 wt. %, more preferably 0.5 to 3 wt. % or an alkyl diethanol amides such as coco diethanol amide (CDEA) or lauryl diethanol amide (LDEA) at a concentration of 0 to 4 wt. %, more preferably 0.5 to 3 wt. %.

Less preferred solubilizing agents are $C_2$–$C_3$ mono and di-hydroxy alkanols, e.g., ethanol, isopropanol and propylene glycol. Suitable water soluble hydrotropic salts include sodium, potassium, ammonium and mono-, di- and triethanolammonium salts of cumene sulfonate or xylene sulfonate (SXS). While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from about 1% to 15%, preferably 2% to 12%, most preferably 3%–8%, by weight of the detergent composition with the proportion of ethanol, when present, being 5% of weight or less in order to provide a composition having a flash point above about 46° C. Preferably the solubilizing ingredient will be a mixture of ethanol and a water soluble salt of a $C_1$–$C_3$ substituted benzene sulfonate hydrotrope such as sodium xylene sulfonate (SXS) or sodium cumene sulfonate or a mixture of said sulfonates or ethanol and urea. Inorganic alkali metal or alkaline earth metal salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of about 0.5 to 4.0 wt. % or urea at the same concentration in combination with ethanol at a concentration of about 0.5 to 4.0 wt. % can be used as solubilizing agents. Other ingredients which have been added to the compositions at concentrations of about 0.1 to 4.0 wt. percent are perfumes, preservatives, color stabilizers, sodium bisulfite, ETDA, and proteins such as lexine protein. One to 4 wt. % of an alkali metal salt of isethionic acid having the formula $CH_2OHCHSO_3H$ can be used in the amide free formula of the instant composition as a substitute for the amide as a solubilizing agent.

The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical perservatives are dibromodicyano-butane, citric acid, benzylic alcohol and poly (hexamethylene-biguamide) hydrochloride and mixtures thereof.

The instant compositions can contain about 0 to about 14 wt. percent, more preferably 0.5 to 10 wt. percent of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fruclosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization) =1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The present light duty liquid detergents such as dishwashing liquids are readily made by simple mixing methods from readily available components which, on storage, do not adversely affect the entire composition. However, it is preferred that the nonionic surfactant be mixed with the solubilizing ingredients, e.g., ethanol and, if present, prior to the addition of the water to prevent possible gelation. When the composition contains less than 14 wt. % of the two anionic surfactants, the surfactant system is prepared by sequentially adding with agitation the two anionic surfactant, and the betaine to the nonionic surfactant which has been previously mixed with a solubilizing system which can be LMMEA and/or LDEA or CDEA to assist in solubilizing said surfactants, and then adding with agitation the formula amount of water to form an aqueous solution of the nonionic based surfactant system. To this system are added the oil containing gelatin beads and the Laponite clay. The use of mild heating (up to 100° C.) assists in the solubilization of the surfactants. No polymeric thickening agent is added. The viscosity of the composition desirably will be at least 150 to about 1,000 centipoises (cps) at room temperature, but may be up to about 800 centipoises as measured with a Brookfield Viscometer using a number 2 spindle rotating at 20 rpms more preferably 200 to 800 cps and most preferably 250 to 650 cps. Its viscosity may approximate those of commercially acceptable compositions now on the market. The composition viscosity and the composition itself remain stable on storage for lengthy periods of time, without color changes or settling out of any insoluble materials. The pH of this formation is substantially neutral to skin, e.g., about 4.5 to 8 and preferably about 5.5 and the composition is optically clear. The compositions of the instant invention are optically clear and have at least 95% light transmission preferably at least 98% light transmission there through. The instant compositions have a minimum foam height of 110 mls after 55 rotations at 40° C. as measured by the foam volume test using 0.75 grams of the composition per liter of water and 1 gram of corn oil per liter of water having a hardness of 300 ppm.

These products have unexpectedly desirable properties. For example, the foam quality and detersive property is equal to or better than standard light duty liquid detergents while using a nonionic surfactant as the primary surfactant and minimal amounts of anionic surfactant, thereby achieving a mild, non-irritating liquid detergent.

The following example was made by the previously described simple mixing procedure at 25° C. and is set forth to define the limits of the two preferred compositions of the instant invention.

| | A |
|---|---|
| Nonionic Neodol 4-9 | 17.3 |
| Ammonium lauryl Sulfate | 4.4 |
| Rewoteric AMB 13 | 4.5 |
| LMMEA | |
| Sodium $C_{14}$–$C_{17}$ paraffin sulfonate | 1.0 |
| Oil containing gelatin beads #HC774 | 0.2 |
| Laponite clay | 1 |
| Water | Bal. |
| Foam test mls | |
| 5 rotations | |
| 50 rotations | |
| Appearance at 74° F. | Clear |

What is claimed is:

1. A light duty, liquid detergent composition comprising approximately, by weight:

(a) 9% to 30% of a water soluble nonionic surfactant;

(b) 0.25% to 6% of a water-soluble anionic sulfonate surfactant;

(c) 0.5% to 8.0% of a water-soluble zwitterionic surfactant;

(d) 0 to 4 wt. % of an alkyl monoethanol amide;

(e) 0.1 to 2.5% of a clay;

(f) 0.05 to 2% of oil containing gelatin beads;

(g) 2 to 15% of an anionic sulfate surfactant; and (h) balance being water.

2. A liquid detergent composition according to claim 1 which includes, in addition, 1% to 15% by weight of at least one additive ingredient selected from the group consisting of alkali metal inorganic salts, alkaline earth metal inorganic salts, urea, proteins, $C_2$–$C_3$ mono- and di-hydroxy alkanols, water soluble salts of $C_1$–$C_3$ substituted benzene sulfonate hydrotropes and mixtures thereof.

3. A liquid detergent composition according to claim 1 further including ethanol in the amount of 5% by weight or less.

4. A liquid detergent composition according to claim 1 wherein said nonionic surfactant is said condensate of a primary $C_8$–$C_{18}$ alkanol with 5–30 moles of ethylene oxide.

5. A liquid detergent composition according to claim 4 wherein said anionic sulfonate is selected from the group consisting of $C_{10}$–$C_{15}$ alkylbenzene sulfonates, $C_{13}$–$C_{17}$ paraffin sulfonates and $C_{12}$–$C_{18}$ alpha olefin sulfonates.

6. A liquid detergent composition according to claim 5 wherein said anionic sulfate detergent is an ammonium or alkali metal salt of a $C_{12}$–$C_{16}$ alkyl sulfate.

7. A liquid detergent composition according to claim 1 further including 0.1 to 4.0 wt. % of a perservative.

8. A liquid detergent composition according to claim 1 further including 0.1 to 4.0 wt. % of a color stabilizer.

* * * * *